US009847572B2

(12) United States Patent
Nowack

(10) Patent No.: US 9,847,572 B2
(45) Date of Patent: Dec. 19, 2017

(54) ARRANGEMENT AND METHOD FOR ELECTRONICALLY TRACKING RF REFLECTOR ANTENNAS

(71) Applicant: EPAK GmbH, Leipzig (DE)

(72) Inventor: Mario Nowack, Schkeuditz (DE)

(73) Assignee: EPAK GMBH, Leipzig (DE)

( * ) Notice: Subject to any disclaimer, the term of this patent is extended or adjusted under 35 U.S.C. 154(b) by 431 days.

(21) Appl. No.: 14/648,507

(22) PCT Filed: Oct. 1, 2013

(86) PCT No.: PCT/DE2013/000554
§ 371 (c)(1),
(2) Date: May 29, 2015

(87) PCT Pub. No.: WO2014/094698
PCT Pub. Date: Jun. 26, 2014

(65) Prior Publication Data

US 2015/0303566 A1 Oct. 22, 2015

(30) Foreign Application Priority Data

Dec. 21, 2012 (DE) ..... 10 2012 025 123

(51) Int. Cl.
*H01Q 3/14* (2006.01)
*H01Q 3/20* (2006.01)
(Continued)

(52) U.S. Cl.
CPC ..... *H01Q 3/14* (2013.01); *H01Q 3/2664* (2013.01); *H01Q 3/446* (2013.01);
(Continued)

(58) Field of Classification Search
CPC ..... H01Q 3/14; H01Q 3/2664; H01Q 3/446; H01Q 13/0241; H01Q 3/12; H01Q 3/16; H01Q 3/20
(Continued)

(56) References Cited

U.S. PATENT DOCUMENTS 2,677,766 A * 5/1954 Litchford ..... G01S 1/02 342/399
2,989,746 A * 6/1961 Ramsay ..... G01S 1/02 343/756
(Continued)

FOREIGN PATENT DOCUMENTS

DE 198 48 202 A1 4/2000
DE 100 41 996 A1 3/2002
DE 10 2007 007707 A1 8/2008

OTHER PUBLICATIONS

English Translation of International Preliminary Report on Patentability for PCT/DE2013/000554.*
(Continued)

*Primary Examiner* — Dameon E Levi
*Assistant Examiner* — Jennifer F Hu
(74) *Attorney, Agent, or Firm* — Walker & Jocke

(57) ABSTRACT

A high-frequency reflector antenna (1) is provided that includes at least one main reflector (2), at least one sub-reflector (3) and at least one horn (4). The stationary elements (5.1, 5.2, 5.3, 5.4, 5.5, 5.6, 5.7, 5.8) for influencing the direction-dependent reception characteristic are present in the beam path between the main reflector (2) and the horn (4). The stationary elements (5.1, 5.2, 5.3, 5.4, 5.5, 5.6, 5.7, 5.8) may protrude into the free aperture area (6) of the horn (4). The stationary elements (5.1, 5.2, 5.3, 5.4, 5.5, 5.6, 5.7, 5.8) are switchable dipole elements (5.1.1, 5.2.1, 5.3.1, 5.4.1, 5.5.1, 5.6.1, 5.7.1, 5.8.1) that are arranged with their dipole axis (15) in a manner to influence the reception
(Continued)

characteristics of elliptically to circularly or linearly polarised high-frequency radiation.

10 Claims, 7 Drawing Sheets

(51) Int. Cl.

| | |
|---|---|
| ***H01Q 3/26*** | (2006.01) |
| ***H01Q 3/44*** | (2006.01) |
| ***H01Q 13/02*** | (2006.01) |
| *H01Q 1/12* | (2006.01) |
| *H01Q 19/19* | (2006.01) |
| *H01Q 23/00* | (2006.01) |

(52) U.S. Cl.
CPC ..... *H01Q 13/0241* (2013.01); *H01Q 1/1257* (2013.01); *H01Q 19/19* (2013.01); *H01Q 23/00* (2013.01)

(58) Field of Classification Search
USPC ..... 343/756
See application file for complete search history.

(56) References Cited

U.S. PATENT DOCUMENTS

| | | | | |
|---|---|---|---|---|
| 3,935,576 | A * | 1/1976 | Pickles | H01Q 3/14 342/398 |
| 4,387,378 | A | 6/1983 | Henderson | |
| 4,774,520 | A | 9/1988 | Bouko et al. | |
| 2010/0085265 | A1* | 4/2010 | Woetzel | H01Q 3/446 343/781 CA |
| 2010/0103065 | A1* | 4/2010 | Shtrom | H01Q 3/24 343/795 |
| 2010/0103066 | A1* | 4/2010 | Shtrom | H01Q 3/24 343/834 |
| 2012/0098701 | A1* | 4/2012 | Loh | H01Q 1/22 342/372 |
| 2015/0214613 | A1* | 7/2015 | Backman | H01Q 1/246 343/803 |
| 2015/0380815 | A1* | 12/2015 | Boutayeb | H01Q 3/24 343/777 |

OTHER PUBLICATIONS

International Search Report for App. No. PCT/DE2013/000554 dated Jan. 14, 2014.

* cited by examiner

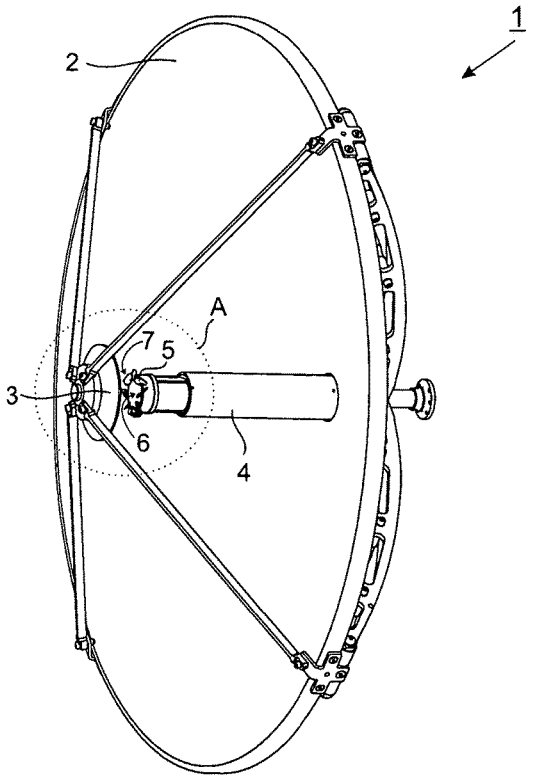
FIG. 1
FIG. 2
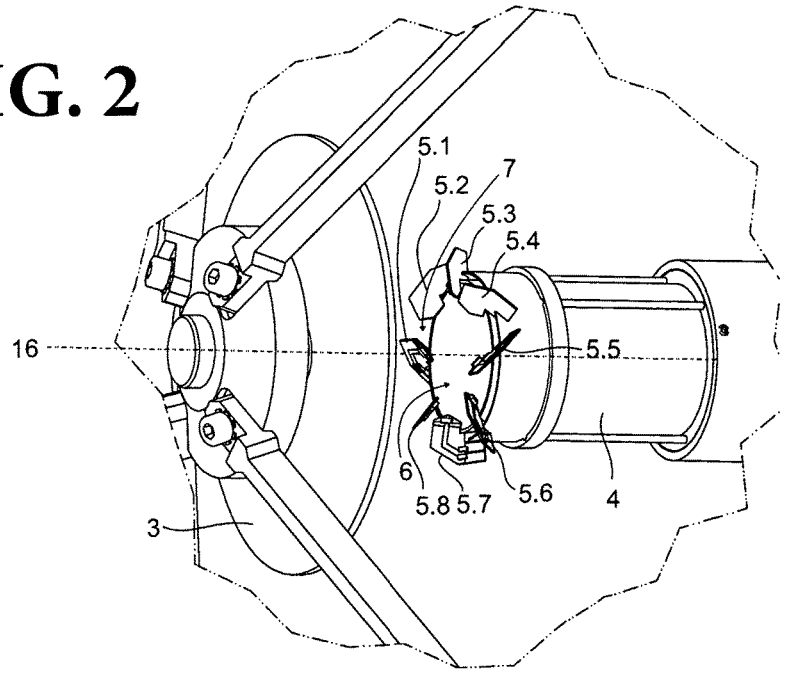

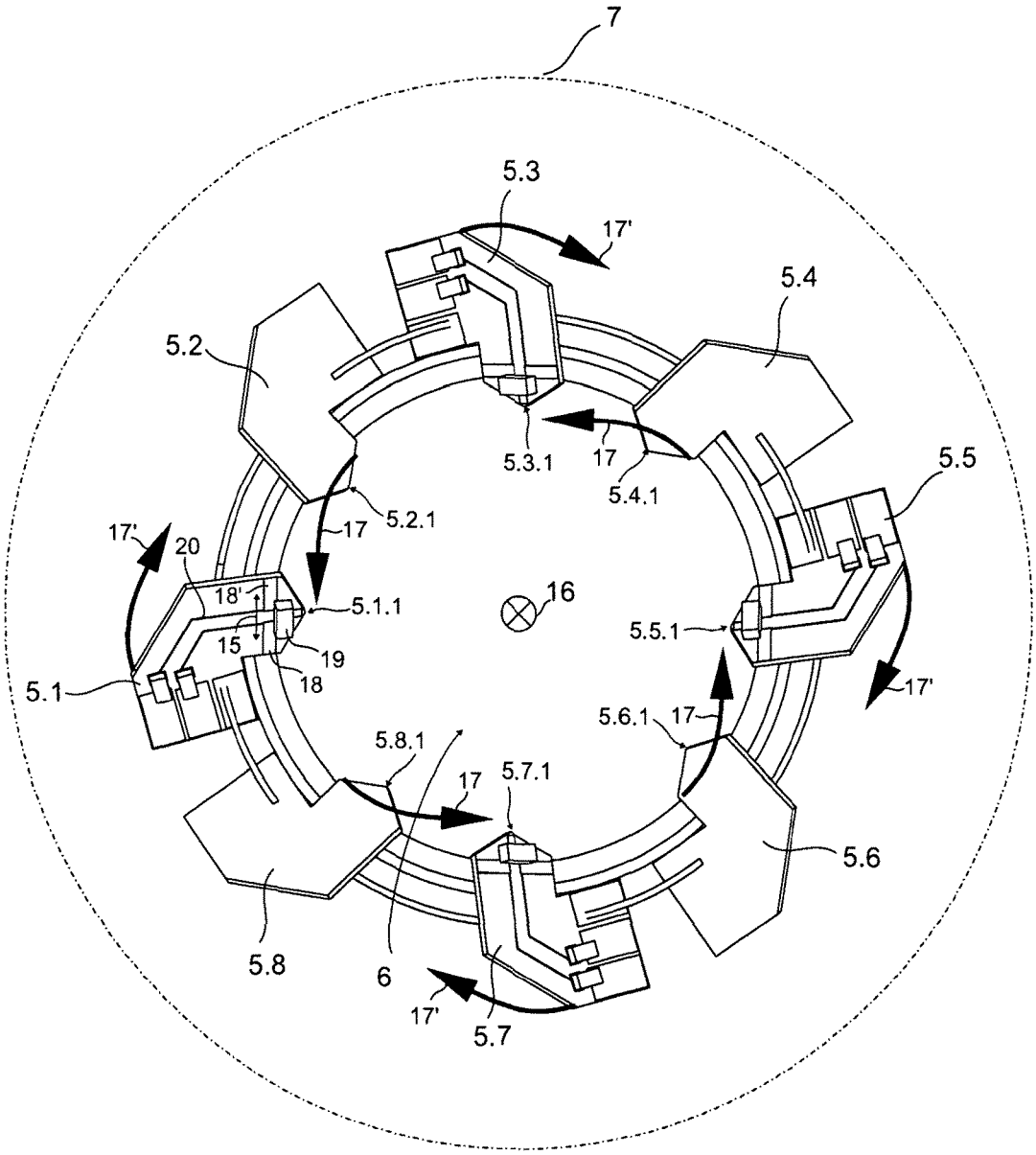
FIG. 4.1

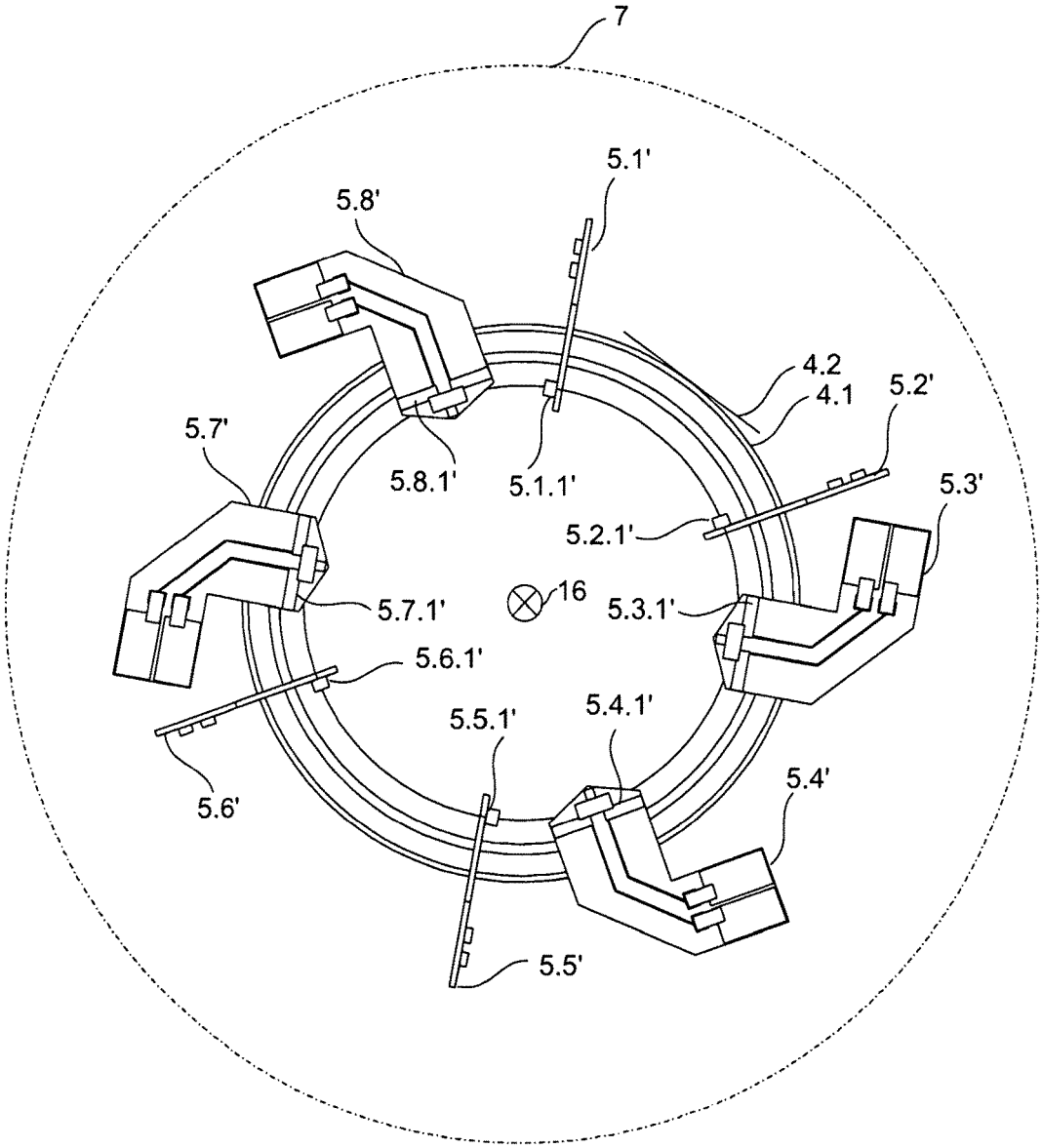
FIG. 4.2

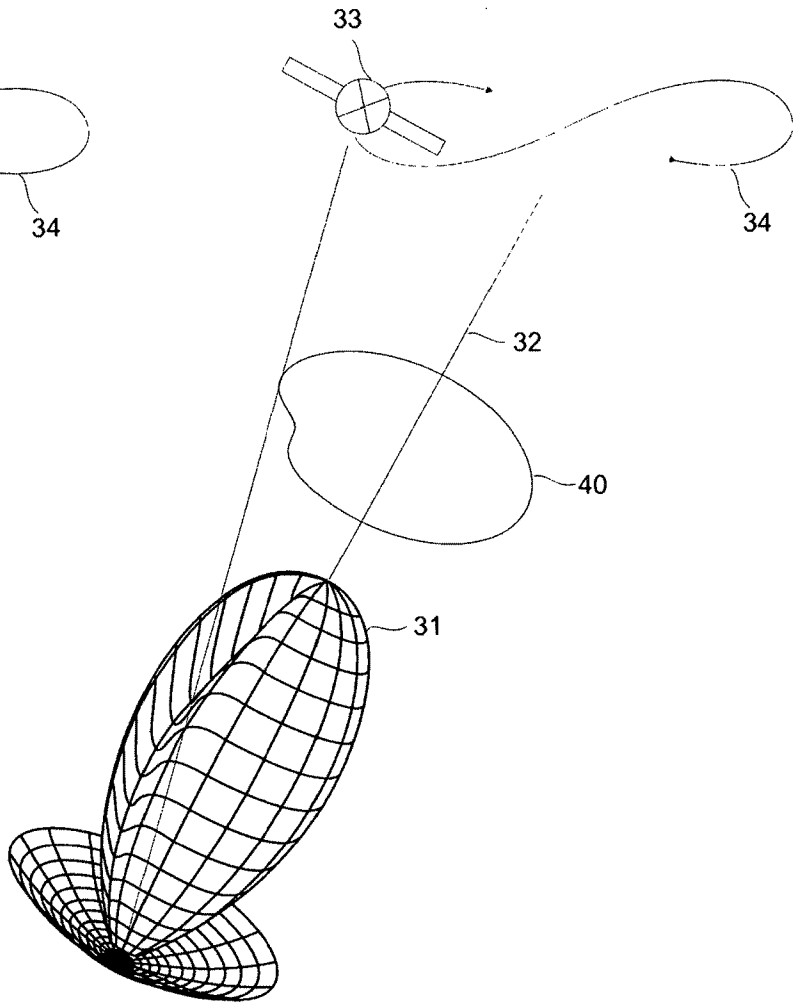
FIG. 5.2
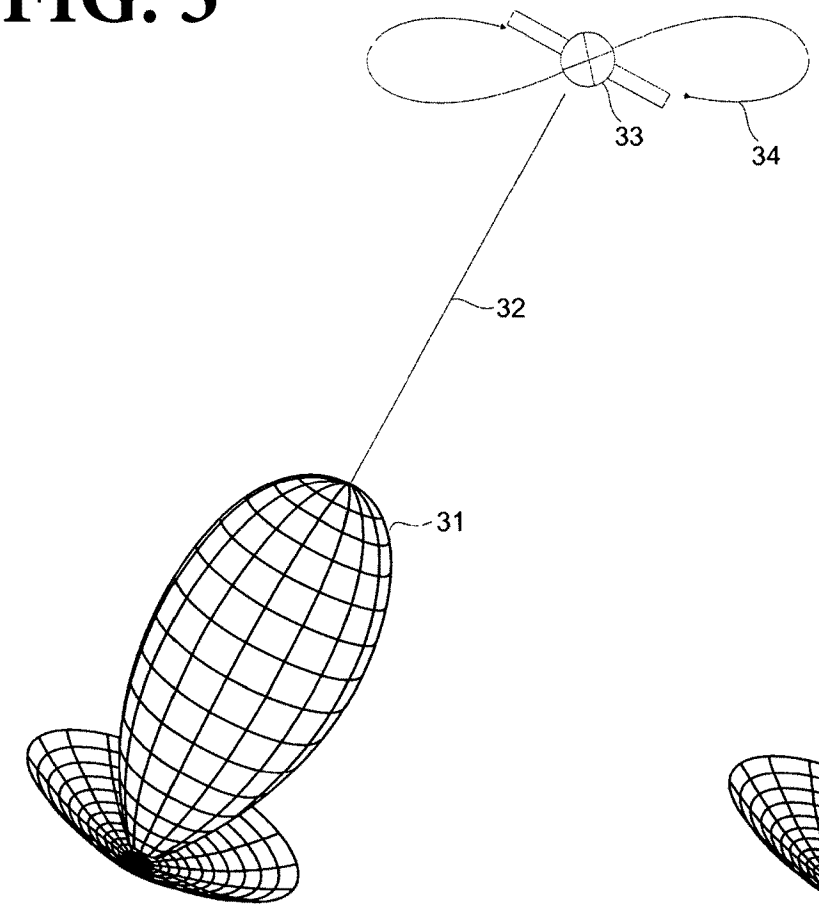
FIG. 5.1
FIG. 5

ARRANGEMENT AND METHOD FOR ELECTRONICALLY TRACKING RF REFLECTOR ANTENNAS

TECHNICAL FIELD

A high-frequency reflector antenna is provided that has at least one main reflector, at least one sub-reflector and at least one horn. Stationary elements for influencing the direction-dependent reception characteristic are provided in the beam path between the main reflector and the horn. A method for the electronic tracking of such antennae is also provided.

BACKGROUND

In order to automatically align a high-frequency reflector antennae in the direction of its signal source in the fields of radio technology, communication technology and defence technology, it is known to guide these to the target, which is movable relative to the antenna, or to the signal source with the aid of mechanical or opto-electronic gyrocompasses. Compass-based tracking however has the disadvantage that the location of the target or the signal source must either be known or at least must be predictable in order to be able, from the compass information, to aim at the location of the target or the signal source. Apart from compass-based target tracking or signal source tracking, it is further known to cyclically or in repeating patterns vary the directional characteristic in the antenna diagram of high-frequency reflector antennae and, from the correlation of the received signal behaviour, derive directional information on the target, which spatially changes relative to the antenna alignment, or on the signal source, which locally changes relative to the antenna alignment.

The German laid-open specification DE 198 48 202 A1 has disclosed a high-frequency reflector antenna, which comprises, in the immediate vicinity of a sub-reflector, a mechanically circulating passive element, which deliberately interferes with the direction-dependent reception characteristic in the antenna diagram of the entire antenna system. Insofar as an aimed-at signal source or an aimed-at target lies in the centre or in the focus of the antenna array, interference from the circulating element does not cause a noticeable change in the received signal because the intensity distribution of the received signal, which is in focus, comprises circular-symmetrical properties. But if the target or the signal source is arranged outside the focus of the reflector antenna, which means that the antenna array is wrongly aligned, the received signal strength of the antenna array correlates with the momentary position of the circulating interference element. In the short moment in which the interference element, viewed from the central horn, covers the direction of the target or signal source, the received signal strength reduces, and when the circulating interference element lies outside the direction of the signal source, the received signal strength increases again. With a circulating interference element, the strength of reception is thus cyclically varied, and a mechanical modulation of the received signal is taking place. Using the mechanically circulating passive interference element leads to useful results which may be used for automatic target or signal source tracking. Nevertheless, the constant presence of the circulating interference element means that there is constant signal reception interference which cannot be switched off, thereby unnecessarily reducing reception quality. With strong signal sources, the deliberately introduced interference can be tolerated. However, with weaker signals or signals which can easily be interfered with, this kind of generating a tracking signal is less suitable.

Since the circulating interference element according to the DE 198 48 202 A1 mentioned in the beginning is arranged in the immediate vicinity of the sub-reflector, the geometric dimensions and thus, the interfering properties of the interference element must be selected very carefully, because in the near and medium field area of the horn, the electrical and magnetic vectors of the received signal are no longer perpendicular to each other, and it is very complicated to theoretically model the electro-magnetic wave properties in this range of the high-frequency reflector antenna, making any predictions very difficult. In the direct vicinity of a horn of generally a high-frequency reflector antenna therefore, the interference effect of an interference element is difficult to predict, and a very small change in the properties of the interference element may cause very big changes in the interference effect.

According to the teaching of the German laid-open specification DE 100 41 996 A1, the method according to the DE 198 48 202 A1 mentioned in the beginning was further developed. Instead of a mechanically circulating interference element which is constantly situated in the near-field area between horn and sub-reflector, a stationary arrangement of elements, specifically selected for a certain preselected polarization of the received signal, was proposed, wherein these elements are electronically switchable. To this end, according to the teaching of the DE 198 48 202 A1, an array of small electronically switchable dipole antennae are positioned in the beam path in the medium field area between the main reflector and the sub-reflector, i.e. in the beam path at a certain distance from the horn. The small dipole antennae may, for example, be switched on and off via a PIN diode in resonance condition with the received signal. Because the electronically switchable dipole antennae are activated in turn (one after the other) the antenna diagram of the high-frequency reflector antenna is deliberately changed. This change in the directional characteristic, which is circulatory and electronically switchable, can then be correlated with an internal synchronized electronically circulating vector signal together with the variation in received signal strength. From the correlation of the interference elements, which are locally activated over time, with the synchronously varying target signal strength or received signal strength, directional information as with the mechanically circulating interference element may be derived, in which there is a target or a signal source which is outside the focus of the high-frequency reflector antenna. This further developed high-frequency reflector antenna has the advantage that the interference elements, the electronically switchable dipole antennae, can be activated and deactivated electronically. Nevertheless, use of this high-frequency reflector antenna is limited to a once preselected polarization of a transmit signal. For the reception of a differently polarized signal source, it is therefore necessary to mechanically alter the electronically switchable elements between the sub-reflector and the main reflector and to align them with the new polarization.

A high-frequency reflector antenna which is used for simultaneously receiving and transmitting, comprises differences in the near and medium field area in the spatial output densities of the high-frequency field between reception and transmission, which differ by up to 120 dB. Insofar as only the reception for directional detection shall be influenced, the arrangement according to the teaching of the DE 100 41 996 A1 suffices. But if the high-frequency reflector antenna is simultaneously or alternately switched into transmission mode, the electronically switchable interference elements and/or the directly adjacent electronic connections may also receive the transmission output of the high-frequency reflector antenna in an undesirable manner. It is therefore necessary to be extremely precise in selecting the spatial positioning of the electronically switchable interference elements. As early as minor changes occur in the spatial position of the electronically switchable interference elements, for example when vibrations occur or if improper adjustments are made to the high-frequency reflector antenna, the wrongly positioned, electronically switchable interference elements, due to the high transmission output, may receive, at best, the transmission output in an undesirable manner and feed it back into the antenna electronics and, at worst, destroy the electronics of the high-frequency reflector antenna.

Experimental measurements taken of the field properties in the medium-field range between the main reflector and the sub-reflector of a high-frequency reflector antenna have resulted in the fact that the arrangement of interference elements in this spatial area leads to usable results for a stable mechanical arrangement and comparatively low sensitivity of the electronically switchable interference elements towards an increased transmission output for a small unintentional misalignment. The medium-field range between the main reflector and the sub-reflector, in relation to the placing of electronically switchable interference elements, is however not suitable for the accommodation of electronically switchable interference elements which are equally suitable for various polarizations of the signal source.

In the German laid-open specification DE 10 2007 007 707 A1 the use of immovably arranged, controllable radiator elements for influencing the directional characteristic of reflector antennae is disclosed. The radiator elements are arranged in the medium-field area of the horn in the beam path between the sub-reflector and the main reflector. The possibilities for influencing the reception characteristic of the reflector antenna in a direction-dependent manner in the near-field area which is very sensitive, even to small interferences, are very limited.

According to the teaching of the U.S. Pat. No. 4,387,378 A the direction-dependent reception characteristic for an antenna with main reflector and horn can be influenced by arranging rod-like elements with adjustable reactance in the horn. However, it is not possible to use these elements for exerting a polarization-specific influence.

SUMMARY

A high-frequency reflector antenna with electronically switchable interference elements for electronic target or signal source tracking, which are insensitive towards small misalignments, and which at the same time offer a very specific interaction with differently polarised transmitter signal radiation is provided. This is accomplished by having the elements protrude into the aperture area of the horn and are thus arranged in the near-field area of the horn. Further advantageous embodiments of this high-frequency reflector antenna are cited in the dependent claims. A corresponding method for electronic tracking of the high-frequency reflector antenna is provided.

According to the exemplary embodiment, provision is made for arranging electronically switchable elements for influencing the direction-dependent reception characteristic in such a way that these protrude into the free aperture area of the horn and are thus arranged in the near-field area of the horn. According to the exemplary embodiment, provision is further made for the elements for influencing the direction-dependent characteristic to be switchable dipole elements, which for influencing the reception characteristic of elliptically to circularly polarised high-frequency radiation are arranged with their dipole axis along a tangent of a helix coaxial to the horn axis, or which for influencing the reception characteristic of linearly polarised high-frequency radiation are arranged with their dipole axis alternately parallel to a tangent of an outer surface of the horn and parallel to the horn axis, or which for influencing the reception characteristic of linearly polarised high-frequency radiation are aligned with their dipole axis alternately parallel to a tangent of an outer surface of the horn and radially to the horn axis and which protrude with only a part of their length into the free aperture surface of the horn.

Surprisingly it was found that precisely in the near-field area, which is very sensitive to small interferences, the reception characteristic of the high-frequency reflector antenna can be influenced in a direction-dependent manner, and that in this area a polarisation-specific interference of the direction-dependent reception characteristic is also possible.

Due to the way in which electronic switchable dipoles are arranged, which have their dipole axis arranged on a tangent to a helix which is coaxial to the horn, their interaction in the high-frequency reflector antenna with the field of a circularly polarised transmitter signal radiation is, on the one hand, so small that a destruction or an unwanted acoustic feedback of the transmit signal into the electronics for generating a tracking signal and thus into the reception electronics of the high-frequency reflector antenna coupled thereto is not possible or at least is suppressible with minor means. On the other hand the previously mentioned interaction is strong enough to influence the received signal of the high-frequency reflector antenna in a direction-dependent manner, in order to be able to derive the correct direction of to a target or a signal source which has migrated out of the focus of the high-frequency reflector antenna.

Due to the way in which electronic switchable dipoles are arranged which with their dipole axis are arranged either on a parallel to a tangent to the outer surface of the horn or in parallel with the horn axis, their interaction in the high-frequency reflector antenna with the field of an optionally vertically or horizontally polarised transmitter signal radiation is, on the one hand, so small that a destruction or unwanted acoustic feedback of the transmit signal into the electronics for generating a tracking signal and into the reception electronics of the high-frequency reflector antenna coupled thereto is not possible or is at least suppressible with minor means. On the other hand the previously mentioned interaction is strong enough to interfere with the received signal of the high-frequency reflector antenna in a direction-dependent manner, in order to be able to derive the correct direction of a target or signal source which has migrated out of the focus of the high-frequency reflector antenna.

In order to influence the direction-dependent reception characteristic in the antenna diagram, it has proven to be especially advantageous if the dipole length for the $K_u$-band is between 11 mm and 15 mm, for example, approximately 13 mm, and for the $K_a$-band is between 6 mm and 10 mm, for example, approximately 8 mm. In order to electronically switch these short dipole lengths, it has proven to be of advantage if individual dipoles consist of two short collinearly opposite electric conductor surfaces which are connected with each other by switchable PIN diodes of SMD design. In order to prevent energy from the high-frequency field from being received by conductor tracks arranged in the immediate vicinity of the PIN diode or being discharged through these conductor tracks, provision is made in an advantageous development of the exemplary embodiment for the electrical supply line for the electronic components to be arranged perpendicular to the horn axis, i.e. radially thereto, with an axial directional component being arranged distinctly outside the free aperture area of the horn for providing here an electrical connection with further electronic switching elements, such as resistances, capacitors, coils or conductor surfaces configured as geometric figures, which as so-called stubs form a high-frequency wave trap, within which undesirable wave energy fizzles out and is therefore converted into heat, or resistances and capacitors for forming a low-pass for blocking the forwarding of high-frequency energy into the electronic components of further electronics.

In order to specifically influence the direction-dependent reception characteristic, provision is made for the elements for influencing the direction-dependent reception characteristic to be activated individually and/or in groups, preferably to be switched on and off or to be tuned by a HF-capable electronic switching element. The interference elements are thus intended to be activated or tuned singly and/or in groups. Insofar as a PIN diode is used for activating a dipole, activation is provided in that the PIN diode is switched on. But it is also possible to position a tunable element respectively in the near-field area of the horn, for example with the aid of tunnel diodes.

In order to improve the directional characteristic of the whole antenna during transmission with regard to the radiated output, it is known to provide the horn with an attachment. This attachment comprises various axial or radial circumferential grooves facing the inside as a rule, in order to utilise these as wave traps. The wave traps of the attachment serve to absorb radiation components straying towards the outside, which, without the use of the attachment known as "corrugated horn", would generate radiation maxima outside a specified small angle range and would thus possibly interfere with satellites adjacent to the aimed-at satellite. Since such an attachment moves the aperture area of the horn by its own length and enlarges the aperture area, this means, in terms of the exemplary embodiment, that if the above described attachment is used, the free aperture area of the attachment replaces the "free aperture area of the horn".

BRIEF DESCRIPTION OF THE DRAWINGS

The exemplary embodiment will now be described in detail with reference to the following figures, in which FIG. 1 shows a view of a high-frequency reflector antenna according to the exemplary embodiment, of the Cassegrain or Gregory type.

FIG. 2 shows an enlarged cut-out of FIG. 1, showing the elements for influencing the direction-dependent reception characteristic.

Figure shows a side view of the aperture opening of the horn with elements arranged above it for influencing the direction-dependent reception characteristic.

FIG. 4 shows a top view of the horn opening with two groups of annularly arranged elements for influencing the direction-dependent reception characteristic.

FIG. 4.1 for circularly polarised transmit radiation.

FIG. 4.2 for linearly polarised transmit radiation.

FIG. 5 shows two sketches of a relative arrangement of the signal source and high-frequency reflector antenna with plotted three-dimensional antenna diagram.

FIG. 5.1 for an unchanged antenna diagram.

FIG. 5.2 for a changed antenna diagram.

Figure 6:
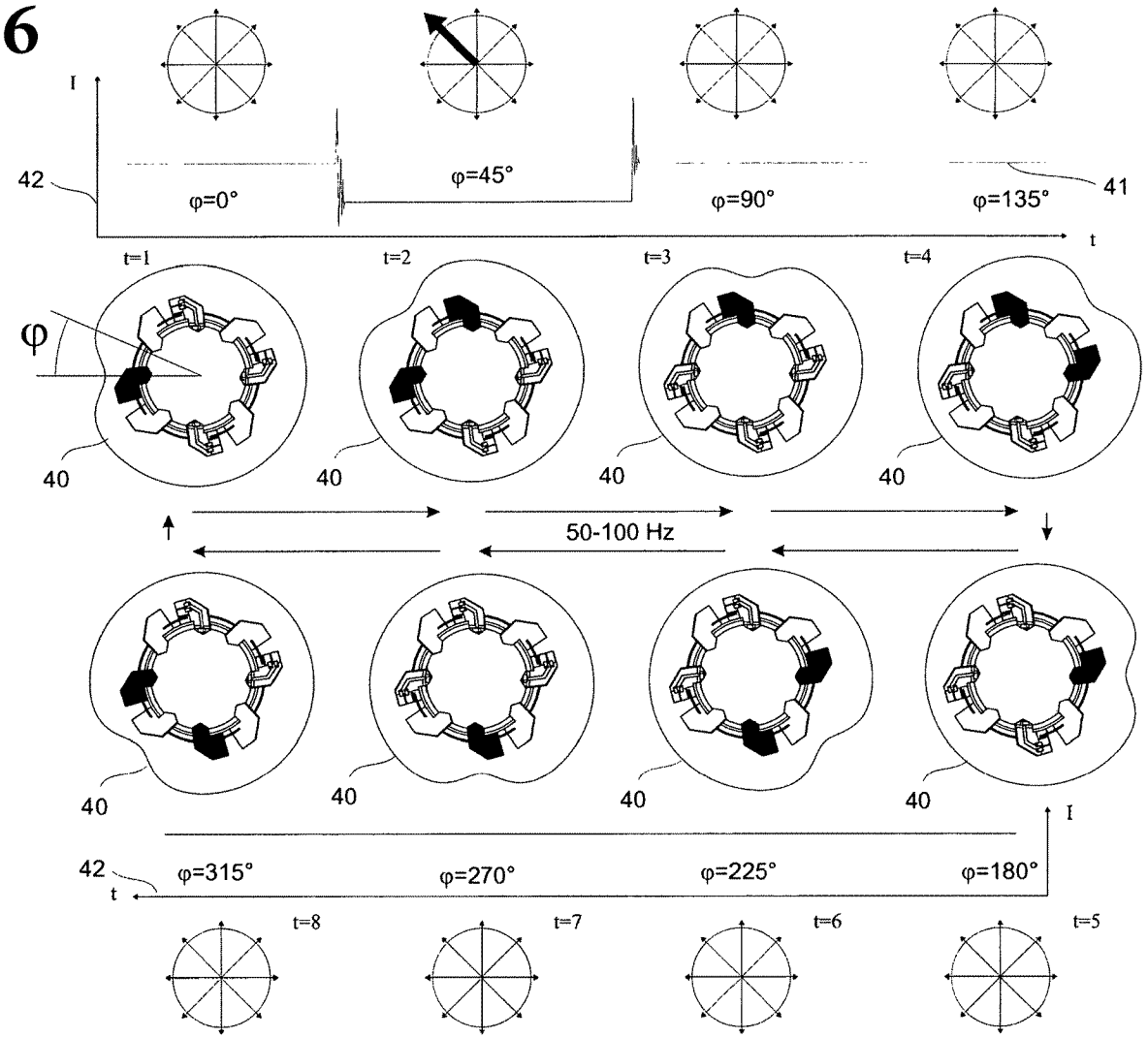

FIG. 6 shows a sketch of a sequence of differently activated elements for influencing the direction-dependent reception characteristic with plotted received signal strength and directional information, using as an example the elements influencing circularly polarised transmit radiation.

Figure 7:
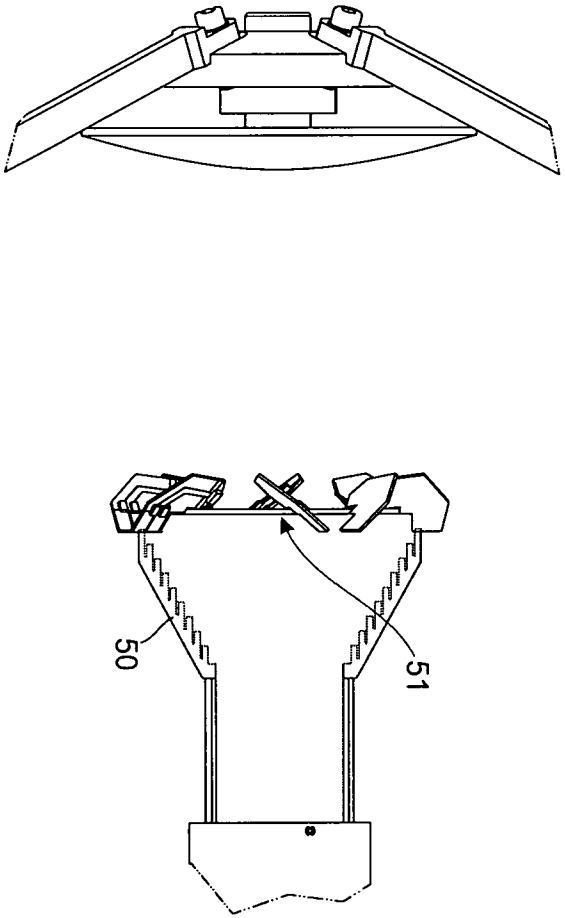

FIG. 7 shows a sketch of an attachment on the horn as a wave trap for illustrating the free aperture area, when such an attachment is used.

DETAILED DESCRIPTION

FIG. 1 shows a generic high-frequency reflector antenna 1 of the Cassegrain or Gregory type comprising a main reflector 2, s sub-reflector 3 and a horn 4 for converting the directional electro-magnetic radiation to be received. In the high-frequency reflector antenna 1 shown here, stationary elements 5.1, 5.2, 5.3, 5.4, 5.5, 5.6, 5.7 and 5.8 are arranged for influencing the direction-dependent reception characteristic of the high-frequency reflector antenna 1. The elements protrude into the free aperture area 6 of the horn 4 and are thus arranged in the near-field area 7 of the horn 4. The encircled area A around the sub-reflector 3 and the horn 4 is shown enlarged in the next figure, FIG. 2.

In FIG. 2, eight elements 5.1, 5.2, 5.3, 5.4, 5.5, 5.6, 5.7 and 5.8 in total for influencing the direction-dependent reception characteristic of the high-frequency reflector antenna 1 can be seen on the rim of the horn 4. Four of the eight elements 5.1, 5.2, 5.3, 5.4, 5.5, 5.6, 5.7 and 5.8, respectively, are a first group G1 consisting of elements 5.1, 5.3, 5.5 and 5.7, and a second group G2 consisting of elements 5.2, 5.4, 5.6 and 5.8 respectively form a common group of elements for influencing the opposing circularly polarised high-frequency radiation. These elements 5.1, 5.2, 5.3, 5.4, 5.5, 5.6, 5.7 and 5.8 divided into the two groups G1 and G2 protrude into the free aperture area 6 of the horn 4 to such an extent that they just protrude into the near-field area 7, which is very sensitive to interferences. In order to avoid the elements 5.1, 5.2, 5.3, 5.4, 5.5, 5.6, 5.7 and 5.8 from interacting with the high-frequency field of the transmit radiation, when the high-frequency reflector antenna 1 is in transmit mode, the dipoles 5.1.1, 5.2.1, 5.3.1, 5.4.1, 5.5.1, 5.6.1, 5.7.1 and 5.8.1 present on the elements 5.1, 5.2, 5.3, 5.4, 5.5, 5.6, 5.7 and 5.8 comprise a length specific for a frequency of the transmitter to be received, which for the transmit frequency show a distinctly lesser interaction with the high-frequency field of the transmit radiation. All the same, any positioning of metallic conductors in the near-field area 7 of the horn 4 of a high-frequency reflector antenna 1 indicates an interference of the high-frequency field in this location, an interference which is very difficult or impossible to predict and which is to be avoided if possible.

Surprisingly, however, the high-frequency field in the near-field area 7 in transmit mode of the high-frequency reflector antenna 1 remains unaffected, but at least the interaction between the elements 5.1, 5.2, 5.3, 5.4, 5.5, 5.6, 5.7 and 5.8 and the high-frequency radiation in the near field 7 is so small that the high output of the high-frequency reflector antenna 1 in transmit mode is not fed back into a control electronics 10 (not shown in the drawings), which is arranged downstream of the horn 4 and the elements 5.1, 5.2, 5.3, 5.4, 5.5, 5.6, 5.7 and 5.8. The surprising behaviour of the elements 5.1, 5.2, 5.3, 5.4, 5.5, 5.6, 5.7 and 5.8 is thought to be due to the fact that in the transmit mode of the high-frequency reflector antenna, the near field 11 of the horn 4 is structured in a way different from the reception mode of the high-frequency reflector antenna 1. The different structuring of the near field 11 may be understandable, since the radiation source 12 (not shown) necessary for the transmit mode builds a slightly different near field 11' at the end of the hollow conductor 13 (not shown) connected with the horn 4 from that which exists there in the reception mode of the high-frequency reflector antenna 1. However, the exact structuring of the near field 11 and 11', although possible, is insufficient even with computer-aided means for theoretically simulating the wave properties in the near field 11 and 11' of a Cassegrain or a Gregory antenna.

In order to enable signal source tracking to be performed specifically with respect to a circular polarisation of the high-frequency radiation, the elements 5.1, 5.2, 5.3, 5.4, 5.5, 5.6, 5.7 and 5.8 in the two groups G1 consisting of odd-numbered elements 5.1, 5.3, 5.5 and 5.7, and G2 consisting of even-numbered elements 5.2, 5.4, 5.6 and 5.8 are arranged in such a way that electronically switchable dipole arrays 5.1.1, 5.3.1, 5.5.1 and 5.7.1 and 5.2.1, 5.4.1, 5.6.1 and 5.8.1 arranged on these elements 5.1, 5.2, 5.3, 5.4, 5.5, 5.6, 5.7 and 5.8 are arranged with their dipole axis 15 (FIG. 4.1) tangentially on a helix 17 coaxial to the horn axis 16.

In order to enable signal source tracking to be performed specifically with respect to a linear polarisation of the high-frequency radiation, the elements 5.1', 5.2', 5.3', 5.4', 5.5', 5.6', 5.7' and 5.8' in the two groups with G1' consisting of odd-numbered elements 5.1', 5.3', 5.5' and 5.7', and G2' consisting of even-numbered elements 5.2' 5.4', 5.6' and 5.8' are arranged in such a way that electronically switchable dipole arrays 5.1.1', 5.3.1', 5.5.1' and 5.7.1' and 5.2.1', 5.4.1', 5.6.1' and 5.8.1' arranged on these elements 5.1', 5.2', 5.3', 5.4', 5.5', 5.6', 5.7' and 5.8' are arranged alternately with their dipole axis 15' (FIG. 4.2) once in parallel to a tangent 4.2 of the outer surface 4.1 and once in parallel to the horn axis 16.

Figure 3:
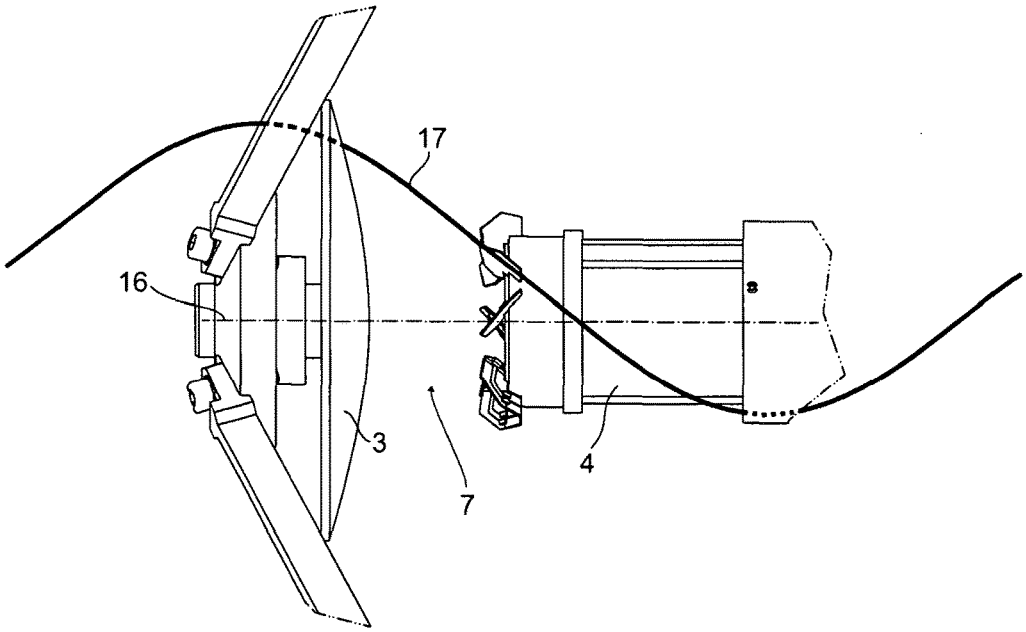

FIG. 3 shows a side view of the horn 4 together with the sub-reflector 3, which is hereby the sub-reflector of a Cassegrain antenna. For clarification of the electronically switchable dipole arrays 5.1.1, 5.3.1, 5.5.1 and 5.7.1 and 5.2.1, 5.4.1, 5.6.1 and 5.8.1 tangentially aligned with a helix 17, an imaginary helix 17 is indicated in FIG. 3, wherein the gradient of the helix 17 does not necessarily correspond to the gradient of the electrical, circularly polarised field to be received. For a wavelength of the high-frequency field of a few millimetres this gradient shown in FIG. 3 is clearly too flat. Rather the gradient of the imaginary helix 17 on which the switchable dipole arrays 5.1.1, 5.3.1, 5.5.1 and 5.7.1 and 5.2.1, 5.4.1, 5.6.1 and 5.8.1 are tangentially arranged, presumably corresponds to the alignment of the locally extended electrical field in the near-field area 7 of the horn 4.

The switchable dipole arrays mentioned in the beginning are illustrated in both FIGS. 4.1 and 4.2 by a top view of the open horn 4. FIG. 4.1 clearly shows that for circular polarisation switchable dipole arrays 5.1.1, 5.3.1, 5.5.1 and 5.7.1 and 5.2.1, 5.4.1, 5.6.1 and 5.8.1 sit on the elements 5.1, 5.2, 5.3, 5.4, 5.5, 5.6, 5.7 and 5.8, which with their dipole axis 15 are aligned along a tangential direction of a right-wound and a left-wound helix 17 and 17'. The switchable dipole arrays 5.1.1, 5.3.1, 5.5.1 and 5.7.1 and 5.2.1, 5.4.1, 5.6.1 and 5.8.1, respectively, consist of conductor track elements 18 and 18' applied to a dielectric carrier, which lie coaxially opposite each other and in the present circuit are electrically conductively connected with each other via an electronic switching element 19, for example a PIN diode. In the electrically conductive state of the electronic switching element 19, the circuit board elements 18 and 18' together with the conductive electronic switching element 19 form a very small dipole antenna, which when the latter is activated, cause a spatially locally limited impedance change of the near-field area 7, wherein the impedance change is ramp-like over time. Insofar as the electronic switching element 19 between two conductor track elements 18 and 18' is rendered non-conductive—with PIN diodes by switching a direct current across the two circuit board elements 18 and 18' off—the resonance condition is interrupted, but at the least the impedance change of the near-field area 7 is decreased, which, among others, depends upon the length of the electrically conductive dipole. Since the individual dipole arrangement, after the electronic switching element 19 has been switched off, is no longer in resonance with the local high-frequency field, at the least however causes only a negligible change in the impedance of the near-field area 7, it absorbs no radiation or at least less radiation, and therefore has no influence or at least only very little influence on the electro-magnetic high-frequency field in the near-field area 7.

According to the idea of the exemplary embodiment, no provision is necessarily made to withdraw part of the reception power in the spatial area which is overshadowed by the switchable dipole arrays 5.1.1, 5.3.1, 5.5.1 and 5.7.1 and 5.2.1, 5.4.1, 5.6.1 and 5.8.1, from the total reception power by electrical discharge, but rather it is the idea of the exemplary embodiment to position 7 node points in the near-field area 7, which change the formation of the wave present in the near-field area 7. This change in the boundary conditions for forming a complex structured near field wave is distinctly different from, for example, hollow conductors fitted laterally to the horn with a switchable element for properly short-circuiting a preselected undesirable mode (e.g. a $TEM_{00}$, $TEM_{01}$) or other mode for selective frequency reception of a non-short-circuited mode.

In order to minimise the interaction of the electrical supply lines 20 for the electronic switching element 19 with the local high-frequency field, provision is made, according to an advantageous development of the exemplary embodiment, for these supply lines 20 to be configured as conductor tracks to extend radially to the horn axis 16, wherein a directional component is arranged distinctly outside the free aperture area 6 of the horn 4 in parallel to the horn axis 16. Due to this arrangement of the supply lines 20, electromagnetic radiation is prevented from being fed back into the control electronics 10 (not shown) in an undesirable manner in the transmit mode.

FIG. 4.2 reveals that for linear polarisation, switchable dipole arrays 5.1.1', 5.3.1', 5.5.1' and 5.7.1' and 5.2.1', 5.4.1', 5.6.1' and 5.8.1' sit on the elements 5.1', 5.2', 5.3', 5.4', 5.5', 5.6', 5.7' and 5.8', which dipoles, with their dipole axis 15', are arranged alternately with their dipole axis 15' once parallel to a tangent 4.2 of the outer surface 4.1 and once parallel to the horn axis 16. In principle, the elements 5.1', 5.2', 5.3', 5.4', 5.5', 5.6', 5.7' and 5.8' work in the same way as the elements 5.1, 5.2, 5.3, 5.4, 5.5, 5.6, 5.7 and 5.8 described for circular polarisation, but their spatial alignment is different compared to the spatial alignment of the elements for circular polarisation. As with the elements for circular polarisation, the elements 5.1', 5.2', 5.3', 5.4', 5.5', 5.6', 5.7' and 5.8' for horizontal and vertical polarisation perpendicular to each other, are divided into two groups, that is group G1' consisting of elements 5.1', 5.3', 5.5' and 5.7' and group G2' consisting of elements 5.2' 5.4', 5.6' and 5.8'.

The first group G1' therefore, comprises an element 5.1', for example, in the 12:00 position and an element 5.5', for example, in the 06:00 position, wherein the dipole 5.1.1' and 5.5.1' positioned on it is, respectively, axially aligned in parallel to the horn axis 16. By contrast elements 5.3' and 5.7' are arranged, respectively, in the approximately 09:00 position and the approximately 03:00 position, and the dipoles 5.3.1' and 5.7.1' are aligned in parallel with a tangent 4.2 of the outer surface 4.1 of the horn 4.

This first group G1' shows an interaction with a linear polarisation vertical in this view, of the wave front moving towards the aperture area 6 of the horn 4. With respect to the vertically aligned electric vector of the vertical polarisation the two dipoles 5.3.1' and 5.7.1' are correspondingly vertically aligned and the two dipoles 5.1.1' and 5.5.1' of elements 5.1' and 5.5' are axially aligned, corresponding to the spatial phase difference of the high-frequency field in propagation direction of the wave front moving towards the aperture area 6. The spatial alignment of the dipoles 5.1.1' and 5.5.1' in the axial direction of the horn 4, which corresponds to the propagation direction of the wave front moving towards the aperture area 6, is due to the fact that these dipoles are interacting both with horizontally polarised wave fronts and with vertically polarised wave fronts. Each group G1' and G2' therefore has two elements, respectively, which work polarisation-specifically, and two elements which work polarisation-unspecifically. In order to make the interaction of all to dipoles polarisation- specific, provision is made for the dipoles on the elements 5.1' and 5.5' to extend in radial direction, protruding, for a small part of their length, into the free aperture area 6 of the horn 4.

This second group G2' shows an interaction with a linear polarisation horizontal in this view, of the wave front moving towards the aperture area 6 of the horn 4. With respect to the horizontally aligned electric vector of the horizontal polarisation, the two dipoles 5.8.1' and 5.4.1' are correspondingly approximately horizontally aligned, and the two dipoles 5.2.1' and 5.6.1' of elements 5.2' and 5.6' are axially aligned, corresponding to the spatial phase difference of the high-frequency field in propagation direction of the wave front moving towards the aperture area 6. The spatial alignment of the dipoles 5.2.1' and 5.6.1' in the axial direction of the horn 4, which corresponds to the propagation direction of the wave front moving towards the aperture area 6, is due to the fact that these dipoles are interacting both with horizontally polarised wave fronts and with vertically polarised wave fronts. Each group G1' and G2' therefore has two elements, respectively, which work polarisation-specifically, and two elements which work polarisation-unspecifically. In order to make the interaction of all dipoles polarisation-specific, provision is made for the dipoles on the elements 5.1' and 5.5' to extend in a radial direction, protruding, for a small part of their length, into the free aperture area 6 of the horn 4.

The effect of the influence of the reception characteristic of a high-frequency reflector antenna is shown in FIG. 5. FIG. 5 shows a reflector 30 with a reception lobe 31 projected thereon. The reception lobe 31 is shown as a three-dimensional graph which maps the spatially dependent antenna gain as an improvement of the received signal strength as compared to an antenna without reflector as coherent area of a plot depicted in polar coordinates. The reception lobe 31 thus has no spatial extension or other kind of spatial structure. Rather it maps the above-mentioned improvement as a linear or logarithmic factor in dependence of two spatial angles, i.e. azimuth which on the earth surface corresponds essentially to the compass direction, and elevation which on the earth surface at mid altitudes corresponds essentially to the angle above the horizon. In direction of the symmetry axis 32 of reflector 30, the high-frequency reflector antenna has the highest antenna gain. For a strong signal reception of the signal source, e.g. a satellite signal from the aimed-at satellite 33 sketched here, the symmetry axis 32 is aligned exactly with the position of the aimed-at satellite 33. This ideal situation is shown in the left sub-figure 5.1 of FIG. 5.

Satellites which due to their age are on a so-called "inclined" orbit, i.e. on a no longer exactly geo-stationary orbit around the earth with an angled eclipse with a mostly elliptical orbit compared to the ideal eclipse, describe in relation to the moving observer on the earth surface, a figure-eight orbit 34. In order to track this orbit 34 with a small high-frequency reflector antenna, it is proposed that the alignment of the high-frequency reflector antenna of, for example, a mobile transmission vehicle of a broadcasting station or the alignment of a communication antenna of a commercial ship, a passenger ship or a warship, or finally the communication antenna of an aircraft or that of a rocket, always follows a variable relative position of the satellite 33. To this end the switchable dipole arrays 5.1.1, 5.2.1, 5.3.1, 5.4.1, 5.5.1, 5.6.1, 5.7.1 and 5.8.1 are activated in variable patterns, but usually one after the other, and during activation the received signal strength 41 of the signal source is measured. Insofar as the received signal strength 41 becomes distinctly weaker or may be stronger for a predefined transient activation pattern because the structure of the reception lobe 31 has changed, this is to be understood as an indicator for the signal source outside the alignment of the symmetry axis 32 of the high-frequency reflector antenna 1. By correlating the activation pattern of the electronically switchable dipole arrays 5.1.1, 5.3.1, 5.5.1 and 5.7.1 and 5.2.1, 5.4.1, 5.6.1 and 5.8.1 with the received signal strength 41, which correlates with the antenna diagram 40, directional information can be derived regarding the direction into which the high-frequency reflector antenna 1 can be moved by means of electro-mechanical or hydraulic final control devices, in order to re-align the symmetry axis 32 of the high-frequency reflector antenna 1, which, depending on the position of the reception unit on the high-frequency reflector antenna 1 is pre-defined by the symmetry axis 32 of the reception lobe 31, again with the symmetry axis 32 of the reception lobe 31.

The right sub-figure 5.2 of FIG. 5 shows, how the reception lobe 31' through selectively changing the spatial reception characteristic comprises a dent, which is linked to a reduction in received signal strength 41 in this spatial area. In order to depict the reception lobe in a two-dimensional manner, a distorted perspective of a two-dimensional diagram 40 has been plotted above the dented reception lobe 31'. The changeability of the reception lobe 31' with different activation patterns of the electronically switchable dipole arrays is shown in the next figure, FIG. 6.

FIG. 6 is a view into the open horn 4 along the symmetry axis 32 of the reception lobe 31' with eight different activation patterns of the electronically switchable dipole arrays 5.1.1, 5.2.1, 5.3.1, 5.4.1, 5.5.1, 5.6.1, 5.7.1 and 5.8.1. In this sketch, a black filled area of the respectively drawn element 5.1, 5.2, 5.3, 5.4, 5.5, 5.6, 5.7 and 5.8 indicates activation of the respective dipole array 5.1.1, 5.3.1, 5.5.1 and 5.7.1 and 5.2.1, 5.4.1, 5.6.1 and 5.8.1 activated on the respective element 5.1, 5.2, 5.3, 5.4, 5.5, 5.6, 5.7 and 5.8. The profile of the reception lobe 31' of the two-dimensional antenna diagram 40 shown only for the azimuth is drawn around the sketched opening of the horn 4 with elements 5.1.1, 5.3.1, 5.5.1 and 5.7.1 and 5.2.1, 5.4.1, 5.6.1 and 5.8.1, as it would look in FIG. 5.2 when viewed from the target or from the signal source. Starting in the left upper corner of FIG. 6 an electronically switchable dipole array 5.1.1 on the black-filled element 5.1 is activated in the 09:00 position. In consequence, assumed here as an example, the received signal strength 41 is reduced in the signal intensity time diagram 42, which depicts the signal intensity I above time t, of a signal source which has migrated in relation to this direction, as shown in the almost circular antenna diagram 40 with a dent in the 09:00 position. In this example, the electronically switchable dipole arrays 5.1.1, 5.3.1, 5.5.1, 5.7.1 are activated one after the other, overlapping with each other in the switching times t=1, t=2, t=3, t=4, t=5, t=6, t=7 and t=8, which correlates with a reduction in received signal strength 41 of a signal source which has migrated in the respective direction. Insofar as a signal source—by way of example—has migrated in approximately 11:00 direction, the received signal strength 41 will be reduced, in this example by t=2, over a cycle for exactly this activation pattern, which is depicted by the received signal strength 41 plotted over time. For tracking, the high-frequency reflector antenna 1 would therefore have to be guided in approximately the 11:00 direction, in order to standardise the received signal strength 41 for all activation patterns at t=1, t=2, t=3, t=4, t=5, t=6, t=7 and t=8. At this point it is important to emphasise that the formation of the near field 11 in the high-frequency reflector antenna 1 is changed due to the electronically switchable dipoles. Thus, the correlation of the activation pattern at t=1, t=2, t=3, t=4, t=5, t=6, t=7 and t=8 with a change in received signal strength 41 is dependent on the exact formation of the high-frequency wave in the near field 11.

The dented reception lobe 31' shown in FIG. 5, sub-figure 5.2, is shown here only by way of example. The actual change of the three-dimensional antenna diagram is far more complex and coincides with a distortion and also twisting of the lob shape. For measuring the migration of a target or a signal source the eight patterns shown by way of example in FIG. 6 are activated one after the other, and at the same time as activation takes place, the strength of the signal intensity is measured. Measurements are taken cyclically over a cycle of t=1 over t=2, t=3, t=4, t=5, t=6, t=7 up to t=8, where a further cycle starts which is carried out identically to the start at t=1. This cycle runs with a frequency of 10 Hz to 100 Hz, 100 Hz to 1,000 Hz or 1,000 Hz to 1 MHz, and if it is found that the received signal strength has weakened, then directional information in accordance with the known activation pattern is generated, which the high-frequency reflector antenna has to follow for tracking. For tracking, it is not necessary to constantly interfere with the signal. Rather it is possible to intermittently take measurements of the target or signal source drift.

The method according to the exemplary embodiment is therefore characterised by individual or group activation and/or tuning of the elements for influencing the direction-dependent reception characteristic, correlating at least one signal strength of at least one reception unit with the activation and/or tuning pattern of the elements for influencing the reception characteristic and providing control signals for a mechanical change of direction of the high-frequency reflector antenna in dependence of the measured correlation. To this end provision is made for the control signals for a mechanical change in direction of the high-frequency reflector antenna to be generated by at least one reception unit, based on the correlation of a change in signal strength coupled with the group activation and/or tuning of one of the elements for influencing the direction-dependent reception characteristic. With respect to their spatial arrangement the elements for influencing the direction-dependent reception characteristic can be activated and/or tuned at a constant or randomly variable frequency in a point-symmetrical, rotating or random manner. The activating pattern sequence is of secondary importance as long as the patterns succeed each other quickly enough, e.g. 10 Hz to 100 Hz, 100 Hz to 1000 Hz or 1000 Hz to 1 MHz, in order to ensure uninterrupted reception.

Since the received signal strength 41 can vary significantly, which may depend upon atmospheric disturbances, undesirable beats of adjacent frequencies or other interfering influences, the exemplary embodiment has been developed to provide for the received signal strength 41 to be correlated, not statically with the activation of a specific activation pattern at times t=1, t=2, t=3, t=4, t=5, t=6, t=7 and t=8, but to allow individual activation patterns of a predetermined frequency to follow one after the other in a loop, so that the dent in the antenna diagram shown in FIG. 5.2 goes round in circles. The received signal strength 41 modulated in this way is supplied via a lock-in amplifier to a further stage for phase correlation, wherein this stage for phase correlation correlates the phase of the activation pattern, which runs in circles, with the phase of the signal from the lock-in amplifier. The phase correlation can also be used for deriving directional information, which has the advantage, in contrast to static correlation of the activation pattern with the direction, that interfering frequencies modulated in an undesirable manner onto the high-frequency signal to be received can be suppressed and directional information can be derived in a more secure manner.

In order to change the direction of the high-frequency reflector antenna 1, an electro-mechanical setting means can be provided, or a hydraulic adjusting means. Finally, for a highly precise alignment of the high-frequency reflector antenna 1, a peristaltic piezo motor can vary the position of the freedom levels of the directional high-frequency reflector antenna. In order to prevent mechanical resonance frequencies of the high-frequency reflector antenna 1 with dimensions of 40 cm minor diameter to 3 m minor diameter and of the carrier system from being stimulated in the case of moving high-frequency reflector antennas, such as in the case of a moving transmission vehicle of a broadcasting station, a ship at sea, a moving aircraft or a rocket in flight, provision is made according to an advantageous development of the exemplary embodiment that the activation patterns are varied remotely from a mechanical resonance frequency or at random, at a randomly varying frequency. This ensures that mountings and carrier elements do not become detached due to resonant vibrations, when the system is in use.

Finally, FIG. 7 shows an attachment on a horn, a so-called grooved horn radiator 50, which is used as a wave trap for avoiding undesirable side maxima (side lobes) of a directional radiator. If a grooved horn radiator is used as a wave trap and for better focussing of the transmitting beam, then the free aperture area 6 of the horn 4 is replaced by the free aperture area 51 of the grooved horn radiator 50, for positioning the elements.

REFERENCE LIST 1 high-frequency reflector antenna
2 main reflector
3 sub-reflector
4 horn

4.1 outer surface
4.2 tangent
5.1 element
5.1' element
5.1.1 dipole array
5.1.1' dipole array
5.2 element
5.2' element
5.2.1 dipole array
5.2.1' dipole array
5.3 element
5.3' element
5.3.1 dipole array
5.3.1' dipole array
5.4 element
5.4' element
5.4.1 dipole array
5.4.1' dipole array
5.5 element
5.5' element
5.5.1 dipole array
5.5.1' dipole array
5.6 element
5.6' element
5.6.6 dipole array
5.6.6' dipole array
5.7 element
5.7' element
5.7.1 dipole array
5.7.1' dipole array
5.8 element
5.8' element
5.8.1 dipole array
5.8.1' dipole array
6 aperture s
7 near-field area
10 control electronics
11 near field
11' near field
12 radiation source
13 hollow conductor
15 dipole axis
15' dipole axis
16 horn axis
17 helix
17' helix
18 circuit board element
18' circuit board element
19 switching element
30 reflector
31 reception lobe
31' reception lobe
32 symmetry axis
33 satellite
34 orbit
41 received signal strength
42 signal intensity time diagram
50 grooved horn radiator
51 aperture area
I signal intensity
T time

The invention claimed is:

1. A high-frequency reflector antenna comprising:
a main reflector;
a sub-reflector;
a horn, wherein the horn includes a free aperture area and a nearfield area;
stationary elements,
wherein the stationary elements are positioned in a beam path between the main reflector and the horn,
wherein the stationary elements are configured for influencing direction-dependent reception characteristics,
wherein the stationary elements protrude into the free aperture area of the horn, wherein the stationary elements are arranged in the near-field area of the horn,
wherein the stationary elements include switchable dipole elements each of which switchable dipole elements includes a respective dipole axis, and
wherein each of the switchable dipole elements is arranged with its respective dipole axis, along a tangent of a helix which extends coaxially to a horn axis, in order to influence direction-dependent reception characteristics of elliptically or circularly polarised high-frequency radiation, or
wherein each of the switchable dipole elements is arranged with its respective dipole axis alternately parallel to a tangent of an outer surface of the horn and parallel to the horn axis in order to influence the reception characteristic of linearly polarised high-frequency radiation, or
wherein each of the switchable dipole elements is arranged with its respective dipole axis aligned alternately parallel to the tangent of the outer surface of the horn and radially to the horn axis with only a part of a length of the respective dipole element protruding into the free aperture area of the horn in order to influence the reception characteristic of linearly polarised high-frequency radiation.

2. The high-frequency reflector antenna according to claim 1, and further including,
at least one control unit,
a) wherein the at least one control unit is operative to activates or tune or both activate and tune the switchable dipole elements to influence the direction-dependent reception characteristic, individually or in groups or both individually and in groups, and
b) wherein the at least one control unit is operative to correlate at least one signal strength of at least one reception unit with an activation or tuning pattern or both activation and tuning patterns of the switchable dipole elements to influence the direction-dependent reception characteristic, and
c) wherein the at least one control unit in dependence of a correlated pattern is operative to provide control signals for a mechanical change in direction of the high-frequency reflector antenna.

3. The high-frequency reflector antenna according to claim 2, wherein a dipole length of the stationary elements, in the direction of the dipole axis, is between 11 mm and 15 mm for the $K_u$-band and between 6 mm and 10 mm for the $K_a$-band.

4. The high-frequency reflector antenna according to claim 3, wherein the switchable dipole elements influence the direction-dependent reception characteristic responsive to activation either individually or in groups.

5. The high-frequency reflector antenna according to claim 4, wherein the switchable dipole elements influence the direction-dependent reception characteristic responsive to being switched on and off or tuned by a high-frequency-capable electronic switching element.

6. The high-frequency reflector antenna according to claim 3, wherein the dipole length of the switchable dipole elements, in the direction of the dipole axis, is approximately 13 mm for the $K_u$-band and 8 mm for the $K_a$-band.

7. The high-frequency reflector antenna according to claim 6, wherein the switchable dipole elements influence the direction-dependent reception characteristic responsive to activation individually or in groups or both individually and in groups.

8. The high-frequency reflector antenna according to claim 7, wherein the switchable dipole elements influence the direction-dependent reception characteristic responsive to being switched on and off or tuned by a high-frequency-capable electronic switching element.

9. The high-frequency reflector antenna according to claim 1, wherein the switchable dipole elements influence the direction-dependent reception characteristic responsive to activation individually or in groups or both individually and in groups.

10. The high-frequency reflector antenna according to claim 9, wherein the switchable dipole elements influence the direction-dependent reception characteristic responsive to being switched on and off or tuned by a high-frequency-capable electronic switching element (19).

* * * * *